US009624644B2

(12) United States Patent
Waldner

(10) Patent No.: US 9,624,644 B2
(45) Date of Patent: Apr. 18, 2017

(54) ATTACHMENT FOR A BUCKET OF A LOADER HAVING AN ADJUSTABLE RETAINING MECHANISM

(71) Applicant: Crystal Spring Colony Farms Ltd, Ste. Agathe (CA)

(72) Inventor: David Waldner, Ste.Agathe (CA)

(73) Assignee: Crystal Spring Colony Farms Ltd., Ste. Agathe, Manitoba (CA)

( * ) Notice: Subject to any disclaimer, the term of this patent is extended or adjusted under 35 U.S.C. 154(b) by 52 days.

(21) Appl. No.: 14/672,742

(22) Filed: Mar. 30, 2015

(65) Prior Publication Data

US 2016/0289918 A1 Oct. 6, 2016

(51) Int. Cl.

| | |
|---|---|
| ***E02F 3/96*** | (2006.01) |
| ***B66F 9/12*** | (2006.01) |
| ***E02F 3/40*** | (2006.01) |

(52) U.S. Cl.

CPC ..... *E02F 3/962* (2013.01); *B66F 9/12* (2013.01); *E02F 3/402* (2013.01)

(58) Field of Classification Search

CPC ..... E02F 3/962; E02F 3/8152; E02F 3/142; E02F 3/402; E02F 3/7604; E02F 3/8155; E02F 3/8157; B66F 9/12; Y10S 37/903

USPC ..... 37/241, 403, 406

See application file for complete search history.

(56) References Cited

U.S. PATENT DOCUMENTS 2,220,819 A * 11/1940 Johnson ..... E02F 3/8152 37/449
2,840,936 A * 7/1958 Rand ..... E02F 3/8152 172/777
2,864,184 A * 12/1958 Fohr ..... E02F 3/401 37/404
3,325,023 A * 6/1967 Coleman ..... B66F 9/12 414/724
3,908,844 A * 9/1975 Duffield ..... E02F 3/401 37/403
4,597,205 A * 7/1986 Guest ..... E01H 5/06 172/273
5,918,389 A * 7/1999 Hall ..... E02F 3/8152 37/407
6,022,184 A * 2/2000 Friedland ..... B66F 9/12 37/405

(Continued)

*Primary Examiner* — Matthew D Troutman
*Assistant Examiner* — Adam Behrens
(74) *Attorney, Agent, or Firm* — Adrian D. Battison; Ryan W. Dupuis; Ade & Company Inc.

(57) ABSTRACT

An attachment for a bucket of a loader, where the bucket includes a bottom wall and a blade extending across an outer surface thereof, features clamping and retaining mechanisms. The clamping mechanism comprises a first clamping surface arranged for engagement with an inner surface of the bottom wall and an opposing second clamping surface arranged for engagement with a bottom surface of the blade. The retaining mechanism comprises a recessed portion longitudinally spaced from the clamping surfaces and an adjustable abutting element in opposite relation to the recessed portion such that the clamping surfaces are located therebetween. The abutting element includes two contact surfaces which are respectively positionable so as to define an abutting surface arranged for butting engagement with a rear surface of the blade. Each working position of the abutting element is suited for retaining a particular width of blade between same and the recessed portion.

7 Claims, 5 Drawing Sheets

(56) References Cited

U.S. PATENT DOCUMENTS

| | | | | | |
|---|---|---|---|---|---|
| 6,085,447 | A * | 7/2000 | Rose | E02F 3/962 | 37/403 |
| D708,554 | S * | 7/2014 | Waldner | B66F 9/12 | D12/162 |
| 8,985,934 | B1 * | 3/2015 | Jennison | E02F 3/962 | 37/403 |
| 2001/0046434 | A1 * | 11/2001 | Burk | B60D 1/00 | 414/723 |
| 2002/0078607 | A1 * | 6/2002 | Perry | E02F 3/8152 | 37/446 |
| 2002/0192053 | A1 * | 12/2002 | Ewington | B66F 3/36 | 414/23 |
| 2009/0129894 | A1 * | 5/2009 | Burenga | E02F 3/962 | 414/24.5 |
| 2010/0212193 | A1 * | 8/2010 | Kostyak | A01B 35/08 | 37/405 |
| 2014/0248111 | A1 * | 9/2014 | Williams | B66F 9/12 | 414/724 |
| 2014/0317968 | A1 * | 10/2014 | Payne | E02F 3/962 | 37/405 |
| 2015/0267377 | A1 * | 9/2015 | Whipple | E02F 3/962 | 37/266 |

* cited by examiner

ATTACHMENT FOR A BUCKET OF A LOADER HAVING AN ADJUSTABLE RETAINING MECHANISM

FIELD OF THE INVENTION

The present invention relates generally to an attachment for a bucket of a loader, and more particularly the present invention relates to an attachment for a bucket of a loader having an adjustable retaining mechanism to fit blades of different widths.

BACKGROUND

Bucket attachment devices which mount to a bucket of a loader are well known. Generally speaking, these attachment devices comprise a working portion which serves at least one of a variety of purposes, such as that of a fork for transporting material or a hitch for towing, as well as a mounting portion for attaching to the bucket. The bucket of a loader commonly has a blade extending laterally thereacross suited for slicing objects or digging into the ground.

Typically, the mounting portions of these attachment devices include: (i) a clamping mechanism arranged for clamping to the bucket at an inner surface of the bucket and a bottom surface of the blade; and (ii) a retaining mechanism arranged for fitting over the blade so as to resist movement in a longitudinal direction of the bucket generally from a rear flat surface of the blade towards a tapered edge of the blade. The retaining mechanism typically includes a fixed surface for butting engagement with the rear flat surface of the blade; however, the blades for buckets of loaders can come in different sizes, especially in terms of width as measured generally between the rear flat surface and the tapered edge. As such, one potential shortcoming of the attachment device with the aforementioned fixed surface is that the device fits only a specific blade width and is incompatible with blades of other widths.

The applicant provides a unique solution that may overcome the potential shortcoming of known constructions of bucket attachment devices.

SUMMARY OF THE INVENTION

According to one aspect of the invention there is provided a combination of a bucket of a loader and an attachment for the bucket comprising:

the bucket having:

a first bottom wall, a second wall inclined relative to the bottom wall so as to form an acute angle therebetween, and side walls bridging adjacent lateral ends of the first and second walls;

the bottom wall having an inner surface facing inwardly generally towards the second wall and an opposing outer surface and a free edge at a common longitudinal free end of the inner and outer surfaces;

the bucket also including a blade extending laterally across the outer surface of the bottom wall adjacent the free edge;

the blade having a first top surface inclined relative to the outer surface of the bucket and a second bottom surface spaced from the outer surface, the first and second surfaces of the blade extending longitudinally outwardly beyond the free edge of the bottom wall and converging at a tapered edge;

the blade further including a third flat surface converging with the second bottom surface at a location longitudinally inward of the free edge of the bucket, the third flat surface extending primarily in a lateral direction; and the attachment comprising:

a working portion;

a mounting portion for mounting to the bucket of the loader, the mounting portion comprising:

a first clamping surface arranged for engagement with the inner surface of the bottom wall;

a second clamping surface opposite the first clamping surface and arranged for engagement with the second bottom surface of the blade;

a recessed portion longitudinally spaced from the at least one of the first and second clamping surfaces and shaped to receive the tapered edge of the blade therein;

an adjustable abutting element in longitudinally opposite relation to the recessed portion such that the clamping surfaces are located generally therebetween, the abutting element being arranged for butting engagement with the third flat surface of the blade so as to resist movement in a longitudinal direction of the bucket when the blade is received between the recessed portion and the abutting element;

the adjustable abutting element supporting at least one contact surface positionable to define an abutting surface for butting engagement with the third flat surface of the blade;

the at least one contact surface being positionable in a first working position in which the abutting surface is longitudinally spaced at a first distance from the recessed portion and in a second working position in which the abutting surface is longitudinally spaced at a second distance from the recessed portion.

The embodiment as described in more detail hereinafter provides the attachment with the adjustable abutting element that is operatively adjustable so as to be positionable between several working positions each of which fit blades of different widths. In this instance, width is generally measured between the tapered edge of the blade and the third flat surface thereof. The general purpose served by the abutting element is to help in retaining the attachment over the bucket and blade.

Typically, the first clamping surface is movable relative to the second clamping surface for providing space between the clamping surfaces to manoeuver the blade between the abutting element and the recessed portion.

The second clamping surface in part defines the recessed portion and the recessed portion comprises a first engaging surface converging with the second clamping surface at an inner vertex of the recessed portion. Typically, the first engaging surface is inclined relative to the fixed clamping surface so as to receive the tapered edge of the blade therebetween. Preferably, the at least one contact surface of the adjustable abutting element comprises two contact surfaces, a first one of the two contact surfaces being longitudinally spaced at the first distance from the inner vertex in the first working position when the first contact surface is defining the abutting surface, and a second one of the two contact surfaces being longitudinally spaced at the second distance from the inner vertex in the second working position when the second contact surface is defining the abutting surface. Preferably, the two contact surfaces are supported on the adjustable abutting element such that the two contact surfaces are longitudinally spaced from one another and in fixed relation relative to one another. It is preferred that the two contact surfaces are supported on transversely opposing sides of the adjustable abutting element (i.e., transverse relative to a longitudinal direction of the mounting portion which lies along the longitudinal direction of the bucket) such that each contact surface is facing generally towards the recessed portion in either one of the first and second working positions. That is, more generally, it is preferred that the at least one contact surface is facing generally towards the recessed portion in either one of the first and second working positions.

Preferably, the adjustable abutting element is generally movable by rotational movement between the first and second working positions about a longitudinal axis. The mounting portion further comprises a frame portion defining supporting, or carrying thereon each one of the clamping surfaces, the recessed portion, and the adjustable abutting element. In one instance, the adjustable abutting element is slidably received over the frame portion such that the abutting surface defined by the at least one contact surface is generally between the first and second clamping surfaces. Furthermore, the adjustable abutting element may be secured to the frame portion by a known fastening arrangement, such as a bolt or a screw with a sleeve in the frame portion for receiving the bolt or screw therein, which holds the abutting element snugly over the frame portion. In order to allow the movement between the first and second working positions, the fastening apparatus is loosened to remove the abutting element from over the frame portion and rotate the abutting element before sliding it back over the frame portion into a different working position.

Preferably, the adjustable abutting element comprises a lip along an outer abutting element periphery of the adjustable abutting element in the lateral direction, at least a portion of the lip defining the at least one contact surface.

Preferably, the at least one contact surface is substantially planar in the lateral direction.

Preferably, the second clamping surface in part defines the recessed portion. In this instance, the at least one contact surface and the first engaging surface of the recessed portion lie in respective planes which converge in a direction generally towards the first clamping surface defining the movable clamping surface.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
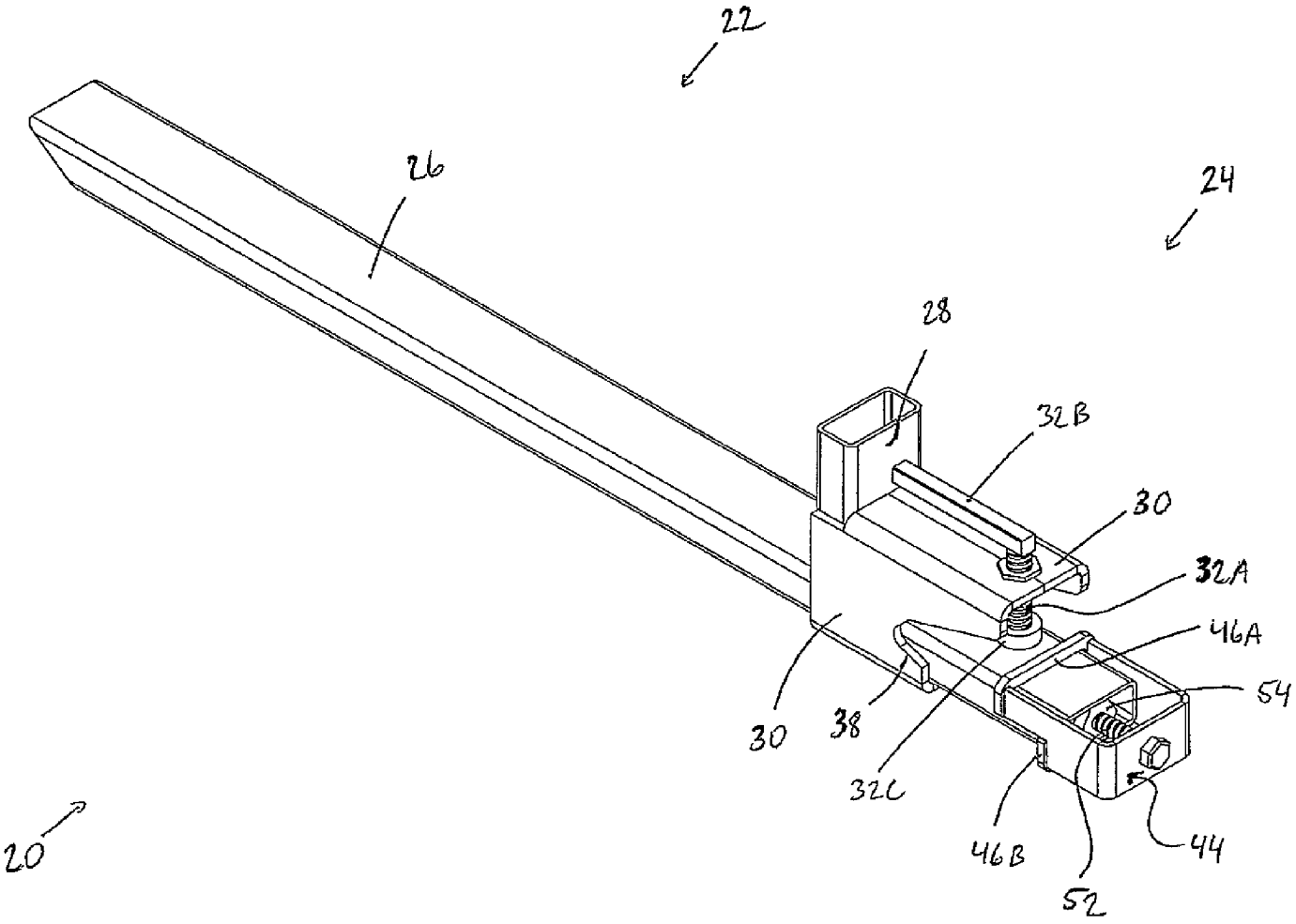
FIG. 1 is an isometric view of the attachment.
Figure 2:
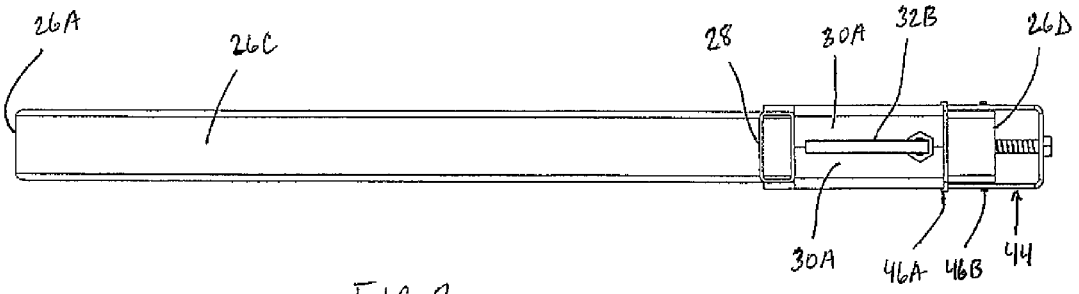
FIG. 2 is a top plan view of the attachment of FIG. 1.

Referring to the accompanying drawings, there is illustrated an attachment generally indicated by reference numeral 20. The attachment is suited for a bucket 1 of a loader 2.

The bucket has a first bottom wall 4 and a second top wall 6 inclined relative to the bottom wall so as to form an acute angle therebetween. The bucket also includes and side walls 8 bridging adjacent lateral ends of the bottom and top walls. The bottom wall comprises an inner surface 4A facing inwardly generally towards the top wall and an outer surface 4B opposite the inner surface. The bottom wall also has a free edge 4C at a common longitudinal free end of the inner and outer surfaces thereof.

A blade 10 is coupled to the bucket 1 so as to extend laterally across the outer surface 4B of the bottom wall 4 adjacent the free edge 4C thereof. The blade includes a first top surface 10A inclined relative to the outer surface 4B of the bucket and a second bottom surface 10B spaced from the outer surface 4B. The top and bottom surfaces of the blade extend longitudinally outwardly beyond the free edge 4C of the bucket and converge at a tapered edge 10C of the blade. The blade further includes a third flat surface 10D extending primarily in a lateral direction and converging with the second bottom surface 10B at a location longitudinally inward of the free edge 4C of the bucket.

Turning now to the attachment 20, the attachment comprises two functional portions: a working portion 22 and a mounting portion 24. The working portion is arranged to serve one of a variety of possible purposes such as that of a hitch receiver or a fork. In the illustrated embodiment, the working portion comprises the fork. In another embodiment, the working portion comprises a receptacle defining a hitch receiver for towing. The mounting portion is arranged for mounting to the bucket 1 of the loader by fitting over the blade 10. As such, the mounting portion comprises a clamping mechanism for securing to the bucket and blade and a retaining mechanism for resisting movement of the attachment relative to the bucket and blade such that the attachment is held in fixed relation to the bucket and blade. The retaining mechanism complements the function of the clamping mechanism such that the retaining mechanism does not necessarily have to be considered as a standalone mechanism. In other embodiments, the retaining mechanism is part of the clamping mechanism.

The attachment comprises a first main member 26 which is elongate in a longitudinal direction. The first main member is rectangular tubular in the illustrated embodiment; the tubular construction is suited for reducing material and thus weight thereof. A front end 26A of the first main member is inclined from a bottom surface 26B to a top surface 26C thereof such that the top surface 26C of the first main member extends further forward than the bottom surface thereof. As such, a front portion of the first main member defines the working portion 22 of the attachment, with the front end 26A of the first main member being shaped like that of a fork typically seen in industrial machinery for transporting pallets or other materials.

A second main member 28 extends transversely from the top surface 26C of the first main member 26 at a location therealong closer to a rear end 26D of the first main member than to the opposing front end 26A thereof. Like the first main member, the second main member is rectangular tubular. Also, the second main member is oriented perpendicularly to the first main member. The mounting portion 24 comprises components of the attachment rearward of the working portion.

A pair of support brackets 30 are received over the first and second main members to form a unitary piece, and each support bracket is generally C-shaped from an end view of the attachment 20. The pair of support brackets overlap the bottom surface 26B of the first main member and side faces of both the first and second main members such that the arrangement strengthens a joint where the first and second main members are coupled together, typically by welding the two main members together. However, other fastening means for attaching the two main members may be used. Top portions 30A of the support brackets are substantially parallel to the top surface 26C of the first main member and extend longitudinally rearwardly from the second main member 28. The top portions carry a threaded clamping member comprising a threaded screw 32A extending between a clamp handle 32B at the top of the threaded screw and a clamping pad 32C at the bottom thereof. The clamping pad defines a first clamping surface 34 of the mounting portion 24 arranged for frictional engagement of the inner surface 4A of the bottom wall of the bucket as more clearly shown in FIG. 7. Frictional engagement is the primary type of engagement between the first clamping surface and the inner surface because the inner surface of the bottom wall is typically flat and planar, as in the illustrated embodiment; however, other types of engagement may be used in other embodiments in which the inner surface has recesses or indentations, or protrusions or bumps. The first clamping surface is movable upwardly and downwardly along a transverse axis perpendicular to the top surface 26C of the first main member and is generally movable relative thereto. Correspondingly, a portion of the top surface 26C of the first main member rearward of the second main member 28 defines a second clamping surface 36 arranged for frictional engagement of the bottom surface 10B of the blade as more clearly shown in FIG. 7. Frictional engagement is the primary type of engagement between the second clamping surface and the bottom surface of the blade because the bottom surface is typically flat and planar, as in the illustrated embodiment; however, other types of engagement may be used in other embodiments in which the bottom surface of the blade has recesses or indentations, or protrusions or bumps. The first and second clamping surfaces collectively define the clamping mechanism of the mounting portion, with the first clamping surface 34 further defining a movable clamping surface and the second clamping surface 36 defining a fixed clamping surface which is stationary relative to the movable clamping surface.

Each support bracket 30 has a symmetrical cut-out 38 in a side portion thereof. The cut-out is shaped to receive the free edge 4C of the bottom wall and the tapered edge 10C of the blade therein and is generally concave about a lateral axis from a rear end of the support bracket to a front end thereof directly adjacent the second main member 28. The cut-out 38 extends longitudinally inwardly in the shape of a 'J' from a start of the cut-out near the top portion 30A of the support bracket to a bottom of a terminal end of the cut out adjacent a bottom portion of the support bracket where same is overlapping the bottom surface 26B of the first main member.

Figure 3:
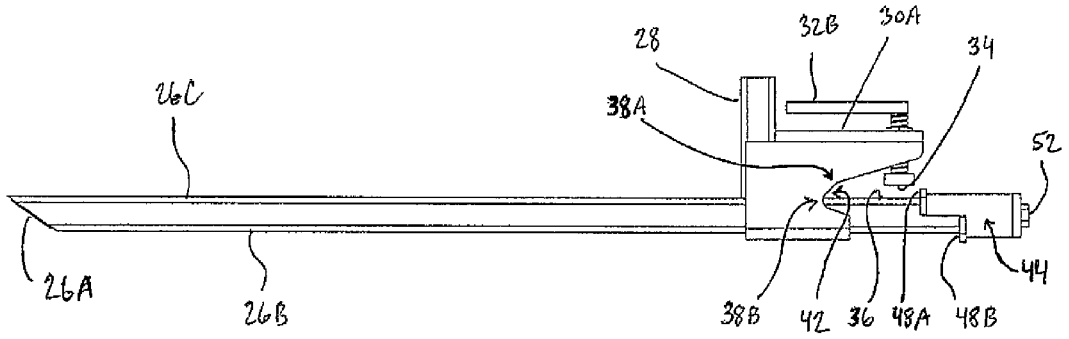
FIG. 3 is a side elevation view of the attachment of FIG. 1.
Figure 4:
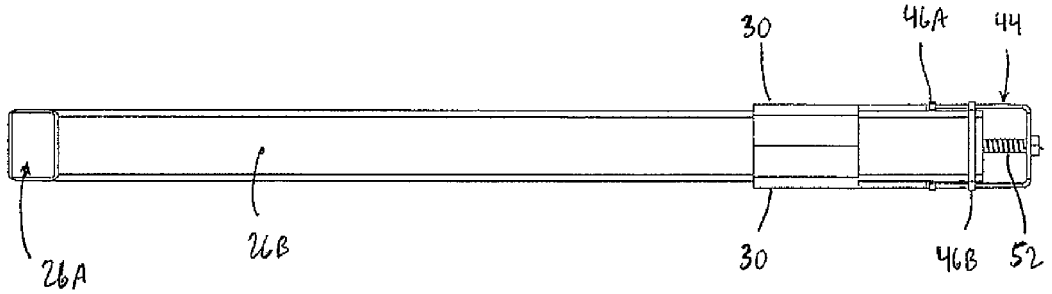
FIG. 4 is a bottom plan view of the attachment of FIG. 1.
Figure 6:
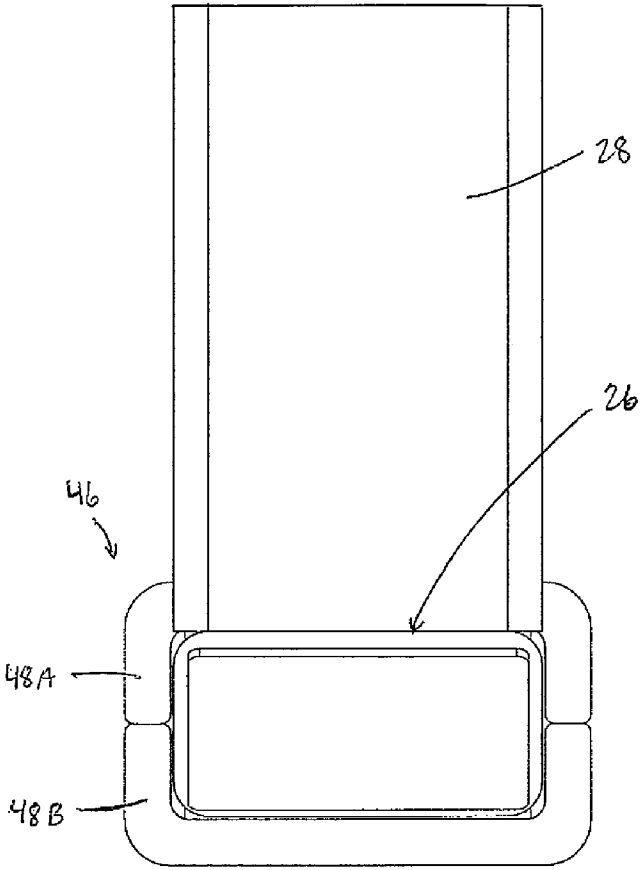
FIG. 6 is a further end view from the front of the attachment of FIG. 1 not showing a portion of the mounting portion to more clearly illustrate the lip of the adjustable abutting element.
Figure 5:
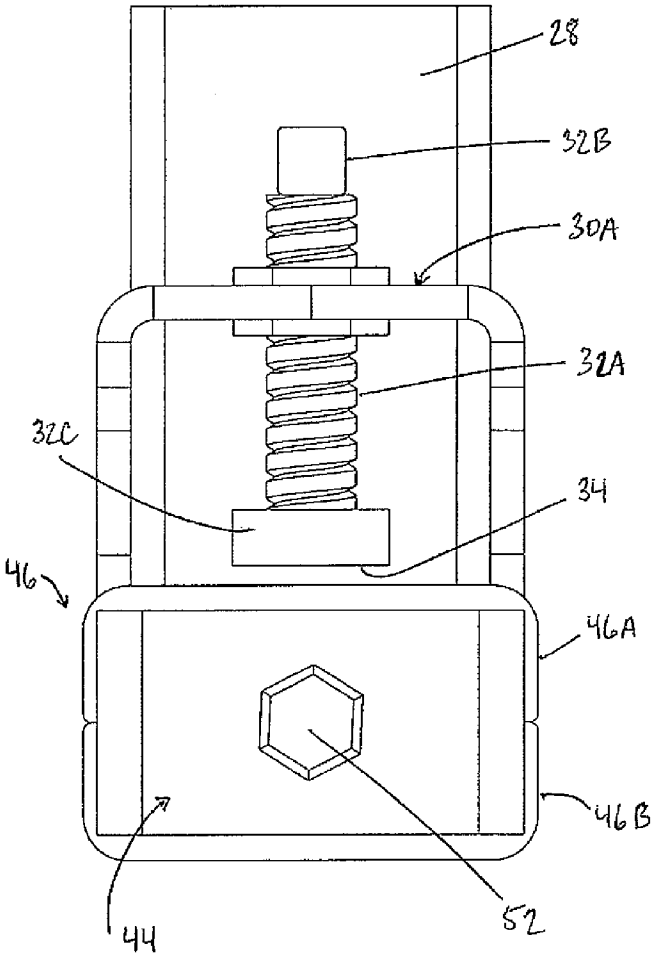
FIG. 5 is an end view from the rear of the attachment of FIG. 1.

An intermediary upper portion 38A of the cut-out between the start and an innermost apex 38B of the concave shape thereof defines a first engaging edge arranged for butting engagement with the top surface of the blade in the illustrated embodiment. However, depending on where the top surface 10A of the blade converges with the outer surface 4B of the bottom wall of the bucket, the first engaging edge 38A may not engage the top surface of the blade when the tapered edge of the blade is received in the cut-out. The first engaging edges of the support brackets 30 collectively define a first engaging surface of the mounting portion. As more clearly illustrated in FIGS. 3 and 7, the first engaging edges generally converge with the top surface 26C of the first main member to define a recessed portion of the mounting portion. As such, the second clamping surface 36 in part defines the recessed portion. The recessed portion includes an inner vertex 42 where the first engaging edges generally converge with the top surface 26C of the first main member. The first engaging edges 38A are inclined relative to the second clamping surface 36 so as to receive the tapered edge 10C of the blade therebetween adjacent the inner vertex 42 of the recessed portion.

An adjustable abutting element 44 is snugly and slidably received over the rear end 26D of the first main member. The adjustable abutting element comprises a lip 46 fixedly supported thereon along an outer periphery of the abutting element. The lip is oriented in a lateral direction transverse to the longitudinal direction of the first main member. The lip is separated into two, longitudinally offset lip portions 46A and 46B, each being generally U-shaped in end view and having a U-shaped lip face facing forwardly generally towards the cut-outs 38 of the support brackets. Each lip face is substantially planar in the lateral direction. When the abutting element is received over the rear end 26D of the first main member, the lip face 48A of a first one 46A of the lip portions is longitudinally spaced rearwardly of the inner vertex 42 at a first distance and the lip face 48B of a second one 46B of the lip portions is longitudinally spaced rearwardly of the inner vertex 42 at a second distance. In the illustrated embodiment, the second distance is greater than the first distance. Each spacing distance corresponds to a different blade width as measured between the tapered edge 10C and the third flat surface 10D. Thus, the lip face disposed generally between the first 34 and second 36 clamping surfaces when the abutting element 44 is received over the first main member 26 defines an abutting surface 50 in longitudinally opposite relation to the recessed portion. The abutting surface is arranged for butting engagement with the third flat surface 10D of the blade. As such, the abutting surface and the recessed portion collectively define the retaining mechanism of the attachment that resists movement of the blade in the longitudinal direction of the bucket when the blade is received therebetween.

Figure 7:
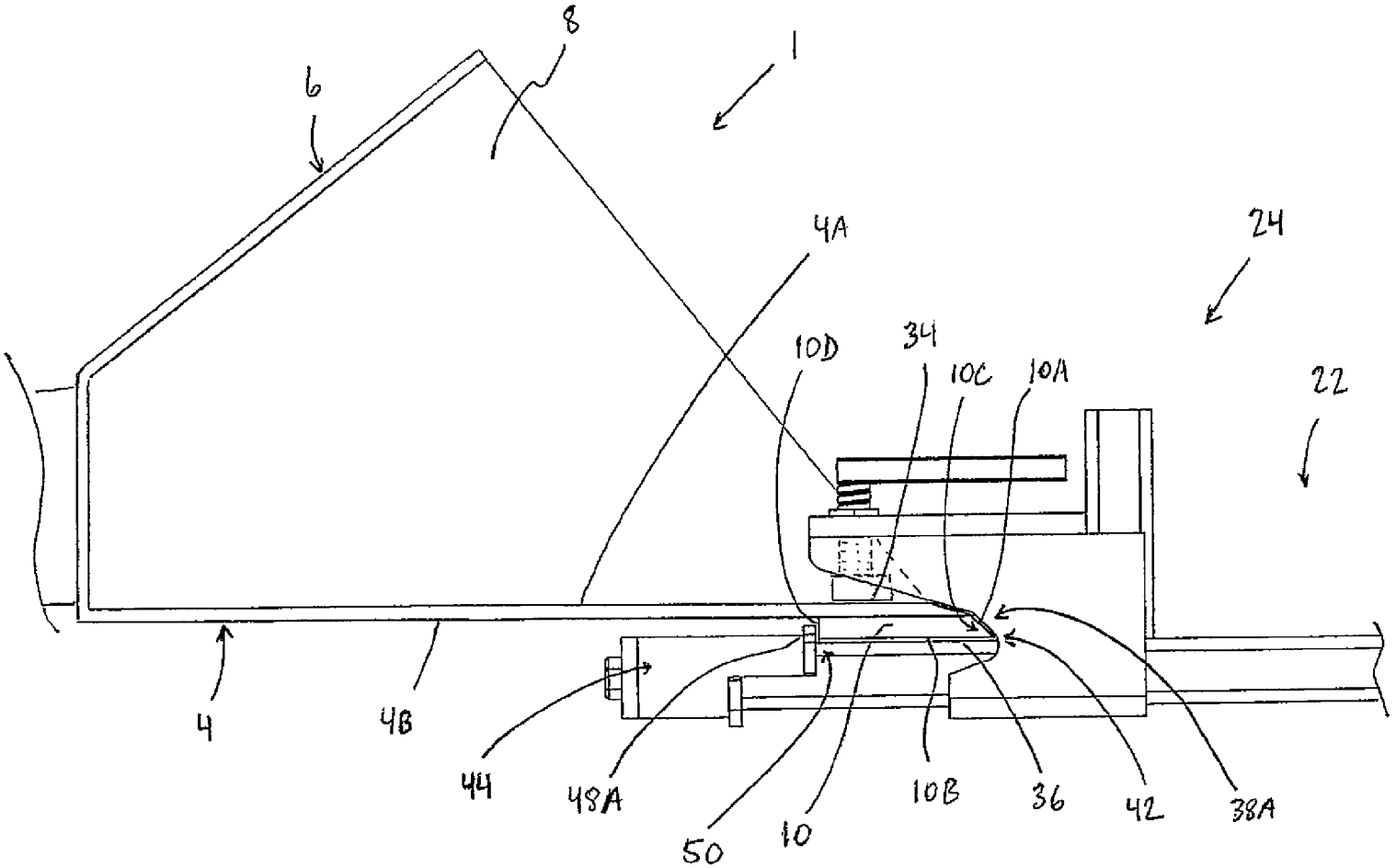
FIG. 7 is a schematic view of the attachment of FIG. 1 mounted to the bucket of the loader with the contact surfaces of the abutting element positioned in the first working position.
Figure 8:
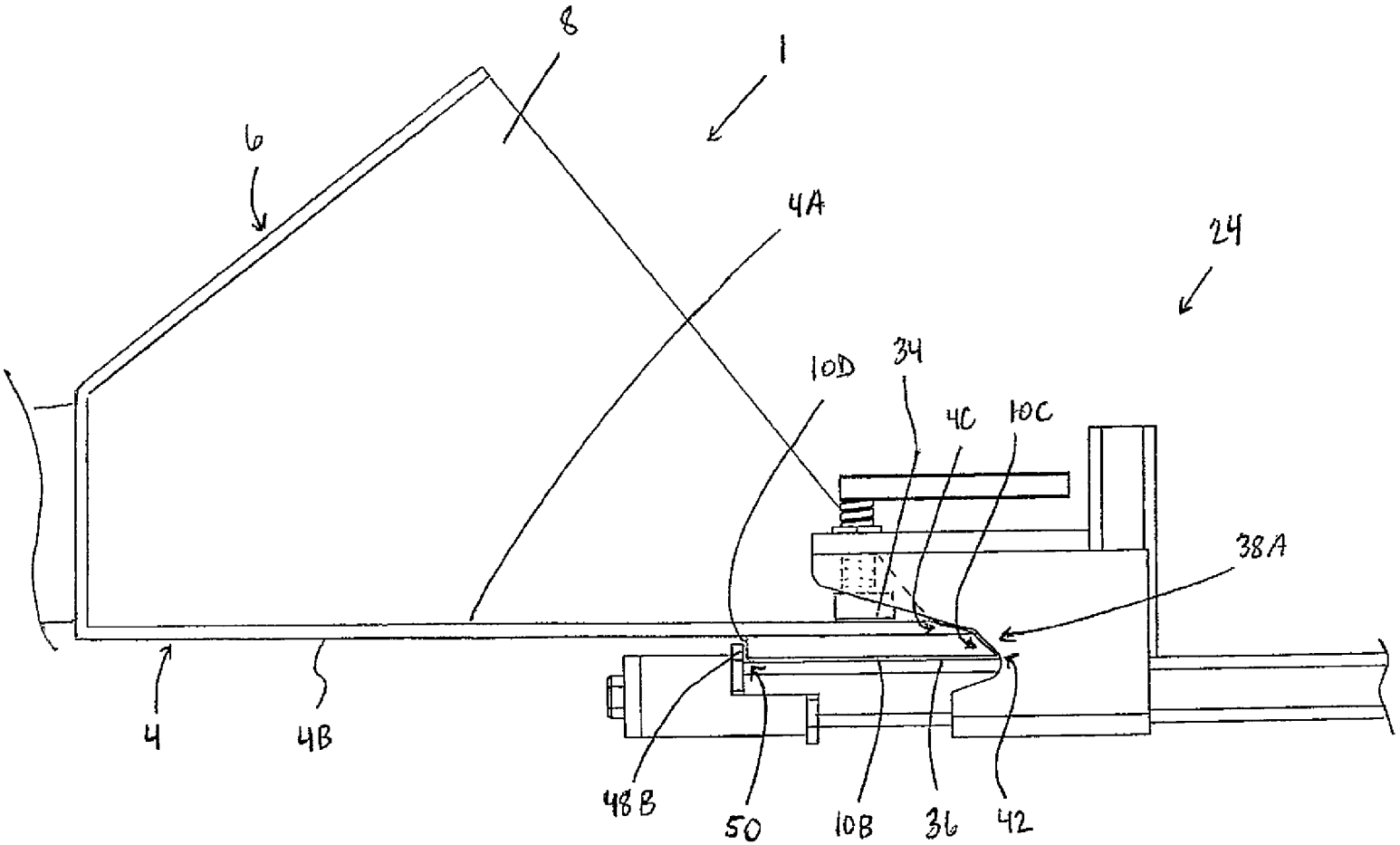
FIG. 8 is a schematic view of the attachment of FIG. 1 mounted to the bucket of the loader with the contact surfaces of the abutting element positioned in the second working position.

Each lip face respectively defines a contact surface which, depending on a specific working position of the abutting element 44, defines the aforementioned abutting surface 50. The abutting element is positionable in a first working position in which the first lip face 48A of the first lip portion defines the abutting surface so that a blade of a first width substantially equal to the first distance may be retained between the abutting surface and the recessed portion which are in butting engagement with the blade of the first width; the first working position is more clearly illustrated in FIG. 7. The abutting element is also positionable in a second working position in which the second lip face 48B of the second lip portion defines the abutting surface so that a blade of a second width substantially equal to the second distance may be retained between the abutting surface and the recessed portion when both are in butting engagement with the blade of the second width; the second working position is illustrated in FIG. 8. As it pertains to the blade, the second width is greater than the first width as shown in FIGS. 7-8. Depending on the bucket 1, certain buckets may be arranged to interchangeably accept blades of different widths, whereas in other instances the blade is fixed to the bucket so that the blade cannot be readily detached therefrom. Notwithstanding the forgoing, blades of different widths are manufactured, and the adjustability of the retaining mechanism in terms of the blade width that can fit therein allows for the attachment to be implemented with different types of blade widths.

The retaining function of the collective arrangement of the abutting surface 50 and the recessed portion works partly because of the snug fitting of the blade therebetween once the blade is manoeuvered therein and also because of orientations of the abutting surface 50 and the first engaging surface defined by the first engaging edges 38A. The first engaging edges of the support brackets 30 are coplanar in the lateral plane, and the plane in which the engaging edges lie converges with a plane extended from the lip face defining the abutting surface 50 in a direction generally towards the first clamping surface 34. As such, when the blade is received in the retaining mechanism of the attachment, the force of gravity helps the tapered edge butt against the inner vertex 42 to help retain the attachment on the blade.

The adjustable abutting element 44 is secured to the first main member, of which the rear portion and the second main member 26 collectively define a frame portion of the mounting portion, by a fastening arrangement of known construction and known to a person with normal skill in the art. In the illustrated embodiment, a threaded bolt 52 carried in a threaded sleeve 54 received in an opening at the rear end 26D of the first main member holds the abutting element 44 in either one of the first or second working positions. The abutting element is movable between its first and second working positions by loosening the threaded bolt 52 so as to slidably remove the abutting element from the first main member 26. The threaded bolt may be of sufficing length such that the bolt is carried in the sleeve 54 even when the abutting element is removed from over the first main member so that the abutting element remains effectively coupled to the frame portion even when swapping working positions. Then, the working position is changed generally by rotational movement about a longitudinal axis of the attachment, which may be defined by the threaded bolt 52 if the bolt is of the sufficing length as described. Securing the abutting element by the threaded bolt provides a user with the option of tightening the bolt to adjust how tightly the abutting surface 50 is pressing against the third flat surface 10D of the blade, and more generally how tightly the blade is squeezed between the recessed portion and the abutting surface.

In use, prior to mounting onto the bucket 1 and blade 10, the first clamping surface 34 is moved away from the second clamping surface 36 to create room for manoeuvering the bucket and blade into the space between the recessed portion and the abutting surface of the abutting element. Also, the abutting element 44 is positioned in the appropriate working position depending on the width of the blade. Then, the user manoeuvers the attachment 20 onto the blade and bucket, during which upper portions of the cut-outs 38 of the support brackets between the starts thereof and the inner vertex 42 may contact the top surface 10A or tapered edge 10C of the blade and the inner surface 4A of the bottom wall in guiding the attachment. With the blade received between the recessed portion and the abutting surface 50 such that the bottom surface 10B of the blade is flat against the second clamping surface 36, the tapered edge 10C is butting against the inner vertex 42, and the third flat surface 10D is flat against the abutting surface 50, the blade is fully received in the retaining mechanism and the first clamping surface 34 is moved towards the second clamping surface 36 to press tightly against the inner surface 4A of the bottom wall. Consequently, the attachment is securely received over the bucket and blade such that the clamping mechanism resists movement in transverse directions substantially upwardly and downwardly relative to the longitudinal direction of the bucket, and the retaining mechanism resists movement in the longitudinal direction of the bucket.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An attachment for a bucket of a loader, in combination with the bucket, comprising:

the bucket including a front edge, an outer wall trailing from the front edge, and side walls for confining material contained in the bucket to an inner surface of the outer wall;

the bucket further including a blade extending laterally across the bucket that is carried at an outside surface of the outer wall at or adjacent the front edge;

the blade having a rear end which is spaced longitudinally inwardly from the front edge of the bucket and a bottom surface extending from the rear end to a leading edge of the blade which is located longitudinally beyond the front edge of the bucket;

the blade having a width from the rear end to the leading edge;

the attachment including:

a mounting portion arranged for coupling to the bucket at or adjacent the front edge in a manner receiving the blade in a mounted condition of the attachment, the mounting portion thus including a recess corresponding to the leading edge of the blade and including a clamping arrangement for clamping to the bucket;

a working portion carried by the mounting portion that is usable for performing a task with the attachment in the mounted condition;

the mounting portion further including an abutting element in opposed spaced relation to the recess such that a receptacle for the blade is defined by the mounting portion therebetween;

the abutting element supporting a pair of contact surfaces, each one of the contact surfaces being distinct from the other;

each contact surface being positionable at the receptacle facing the recess to define an abutting surface for butting engagement with the rear end of the blade such that in the mounted condition, in which the leading edge of the blade is in the recess and the abutting surface is abutting the rear end of the blade, movement of the attachment longitudinally of the bucket is resisted;

where in a first working position of the abutting element the abutting surface is defined by a first one of the contact surfaces which is located at the receptacle facing the recess;

where in a second working position of the abutting element the abutting surface is defined by a second one of the contact surfaces which is located at the receptacle facing the recess;

the first one of the contact surfaces in the first working position being spaced from the recess at a first distance and the second one of the contact surfaces in the second working position being spaced from the recess at a second distance such that the attachment is receivable over different widths of blade.

2. The attachment according to claim 1 wherein the contact surfaces are supported in fixed and longitudinally spaced relation to one another on the abutting element.

3. The attachment according to claim 1 wherein the contact surfaces are supported on the abutting element facing in a direction of the recess in either one of the first and second working positions.

4. The attachment according to claim 1 wherein the abutting element is movable between the first and second working positions by rotating the abutting element from one of the working positions to the next so as to present the corresponding contact surface at the receptacle facing the recess.

5. The attachment according to claim 1 wherein the abutting element comprises a lip along transverse periphery of the adjustable abutting element, at least a portion of the lip defining the pair of contact surfaces.

6. The attachment according to claim 1 wherein the mounting portion comprises a frame portion with an end opposite the recess, and the abutting element is slidably received over the frame portion at said end.

7. The attachment according to claim 1 wherein the abutting element is wholly at a common location in each of the first and second working positions.

* * * * *